United States Patent [19]

Alexeeff

[11] 4,364,489

[45] Dec. 21, 1982

[54] CONTAINER LID

[75] Inventor: Victor Alexeeff, Weston, Canada

[73] Assignee: Nestier Canada Inc., Ontario, Canada

[21] Appl. No.: 292,879

[22] Filed: Aug. 10, 1981

Related U.S. Application Data

[63] Continuation of Ser. No. 144,401, Apr. 28, 1980, abandoned.

[51] Int. Cl.[3] ..... B65D 43/14; B65D 51/04

[52] U.S. Cl. ..... 220/334; 220/21; 220/337

[58] Field of Search ..... 220/21, 334, 337, 339, 220/DIG. 15, 342, 333; 229/44 R

[56] References Cited

U.S. PATENT DOCUMENTS

| | | | |
|---|---|---|---|
| 3,245,573 | 4/1966 | Bakos | 220/21 |
| 3,262,561 | 1/1968 | Bakos | 220/21 |
| 3,463,345 | 8/1969 | Bockenstette | 220/337 |
| 3,659,741 | 5/1972 | Corelli | 220/453 |
| 4,161,261 | 7/1979 | Frater | 220/337 |

*Primary Examiner*—George E. Lowrance
*Attorney, Agent, or Firm*—Thomas E. Beall, Jr.

[57] ABSTRACT

A stacking container having a bottom and two pairs of opposed side walls, a cover comprising two portions hinged to one pair of opposed side walls, the opposed lateral edges of each cover portion engaging the upper edges of the other pair of opposed side walls of the container when in closed position, the outer free edges of the cover portions meeting, when the cover is in closed position, to present a flat upper surface of the cover. The free edges of the cover portions are crenellated, with a plurality of spaced teeth having recesses therebetween, to interfit one with the other when closed. Each of at least a plurality of teeth and corresponding recesses are configured to interengage when the cover portions are closed to inhibit lateral separation of the cover portions one from the other. Each cover portion is sealable one on each of the other pair of opposed side walls.

16 Claims, 7 Drawing Figures

CONTAINER LID

This is a continuation, of application Ser. No. 144,401, filed Apr. 28, 1980, now abandoned.

FIELD OF THE INVENTION

This invention relates to a stacking container or bin for shipping packed goods and more particularly to a cover or lid for closing such a container.

BACKGROUND OF THE INVENTION

Sealable containers or tote boxes are presently used in merchandising to facilitate the transportation of piece goods such as hardware items which can be loaded into the containers. One type of box is disclosed in Canadian Pat. No. 844,948 issue June 23, 1970 to M.S. Industries Incorporated assignee of Kenneth R. Bockenstette. In that boxk the outer free edges of the cover elements have complementary raised and depressed areas which interfit when the cover elements are closed to present an upwardly flat surface for stacking purposes. A problem associated with such a box construction is that it does not protect the box adequately against pilferage. In other words, it is possible to gain entrance to the box and remove a portion of the contents without detection.

It is an object of the present invention to provide a container which will give increased protection against pilferage.

SUMMARY OF THE INVENTION

Essentially the invention consists of a stacking container having a bottom and two pairs of opposed side walls, a cover comprising two portions hinged to one pair of opposed side walls, the opposed lateral edges of each cover portion having means to engage the upper edges of the other pair of opposed side walls of the container when in closed position, the outer free edges of the cover portions meeting, when the cover is in closed position, to present a flat upper surface of the cover, with a plurality of spaced teeth having recesses therebetween, to interfit one with the other when closed, means on each of at least a plurality of teeth and in each corresponding recess interengaging when the cover portions are closed to inhibit lateral separation of the cover portions one from the other, each cover portion being sealable one on each of the other pair of opposed side walls.

DESCRIPTION OF THE DRAWINGS

An example embodiment of the invention is shown in the accompanying drawings in which.

DESCRIPTION OF PREFERRED EMBODIMENT

Figure 1:
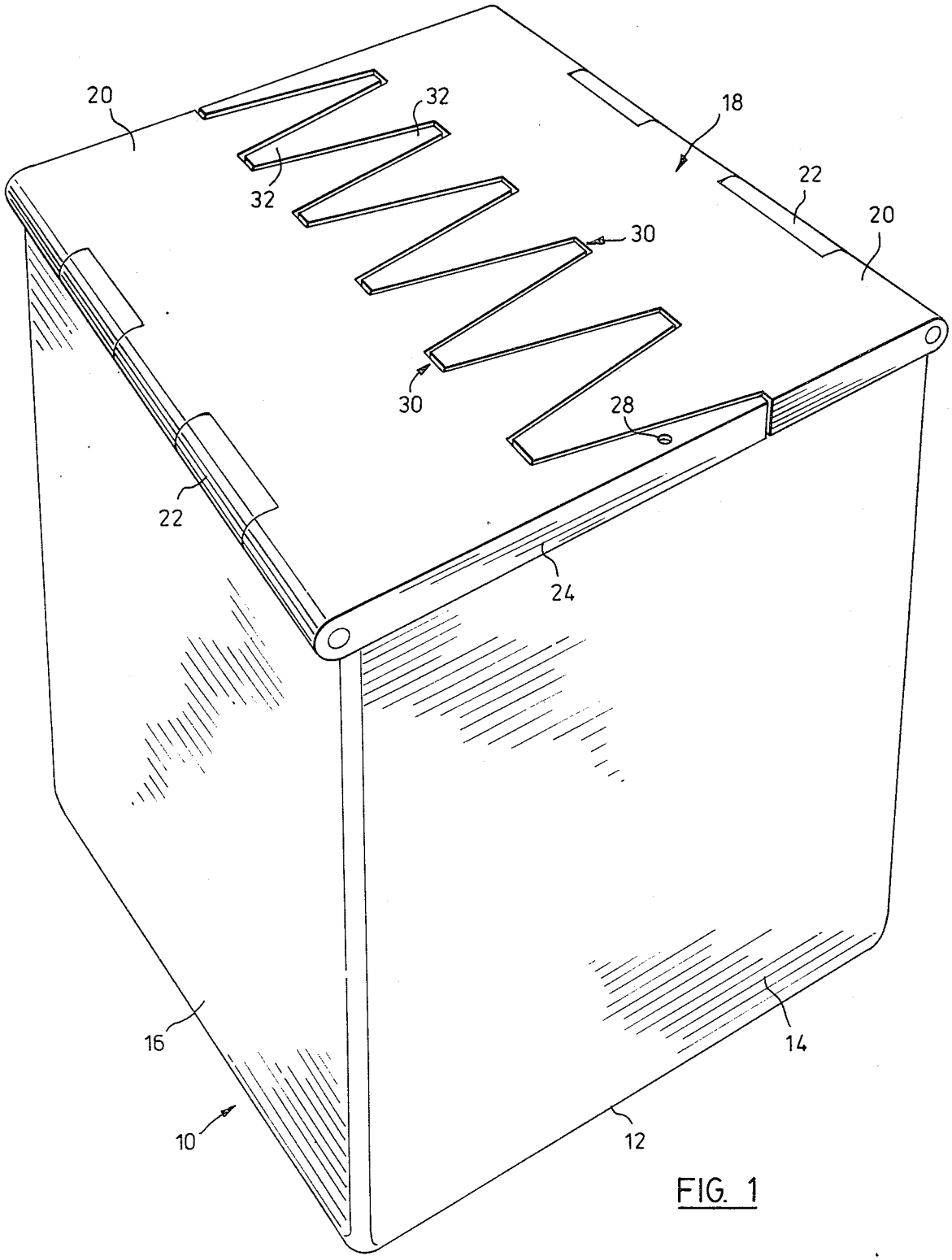
FIG. 1 is a perspective view of a stacking container having a pair of hinged cover portions in closed position.
Figure 2:
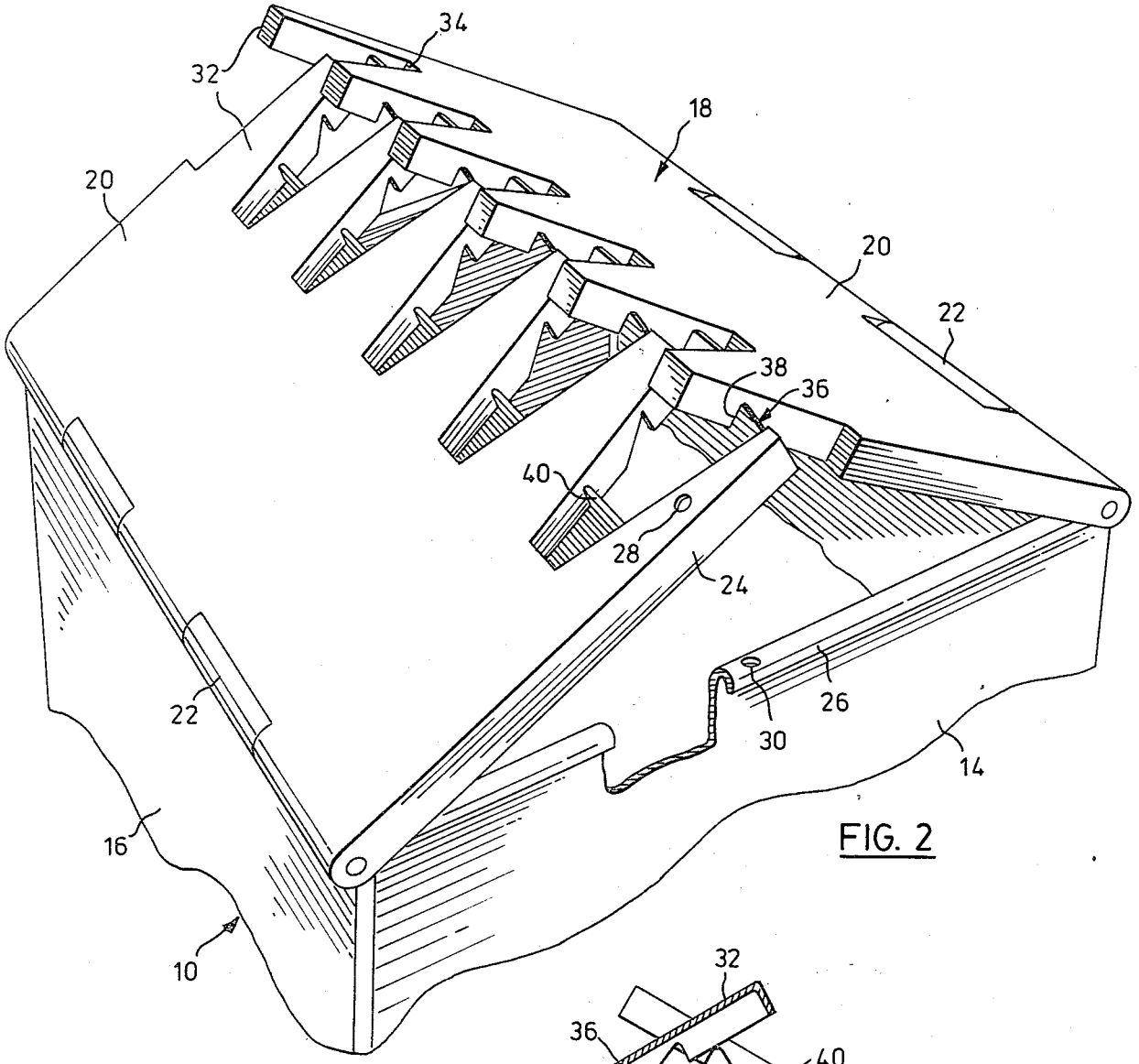
FIG. 2 is a view of the upper portion of the container of FIG. 1 showing the cover portions in partially opened position.

The example embodiment consists of a container 10 having a bottom 12, a first pair of opposed side walls 14, a second pair of opposed side walls 16, and a cover 18 comprising a pair of cover portions 20 one attached to the top edge of each side wall 16 by a hinge 22 and presenting a flat surface when closed. The lateral edges of each cover portion 20 carry means to engage the adjacent side walls 14 of container 10 in the form of channels 24 which overlap the upper rims 26 of side walls 16. An aperture 28 in one channel 24 of each cover portion 20 and an aperture 30 in each rim 26 provide means for sealing container 19 using wire or the like (not shown).

Cover portions 20 each have an outer free edge 30 remote from hinge 22 and each outer free edge of the cover portions is crenellated, with a plurality of spaced teeth 32 having recesses 34 between the teeth whereby the cover portions interfit one with the other when closed.

Each tooth 32 is undercut intermediate its ends to form a transverse notch 36 with a vertical face 38 on that side of the notch towards the free end of the tooth. Each recess 34 is bridged transversely by a vertically disposed flange 40 spaced from the base of the recess substantially the same distance as notch 36 is spaced from the free end of tooth 32.

Figure 3:
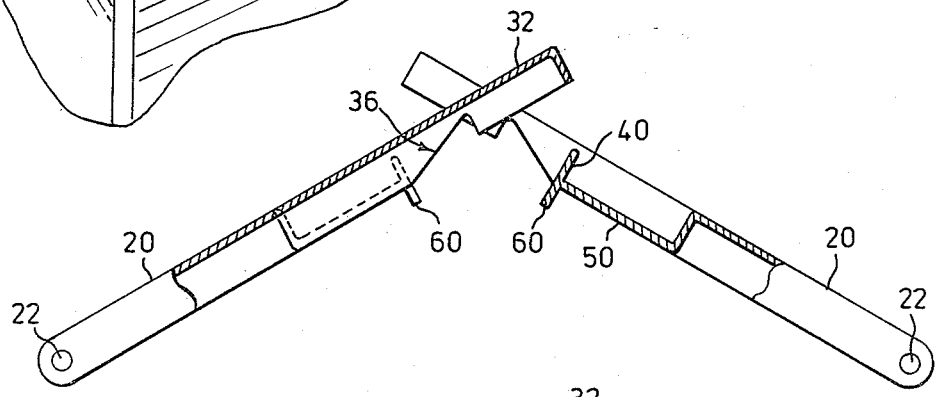
FIG. 3 is a cross-sectional view of the cover portions of the container in partially opened position as seen in FIG. 2.
Figure 4:
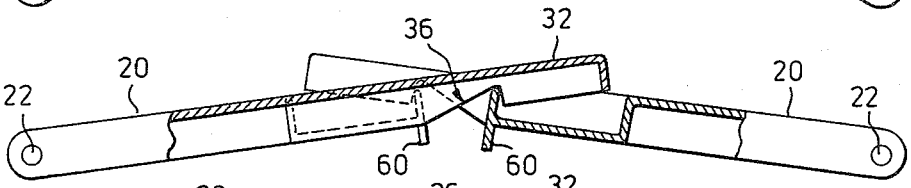
FIG. 4 is a cross-sectional view similar to FIG. 3 showing the cover portions advanced towards a closed position.
Figure 5:
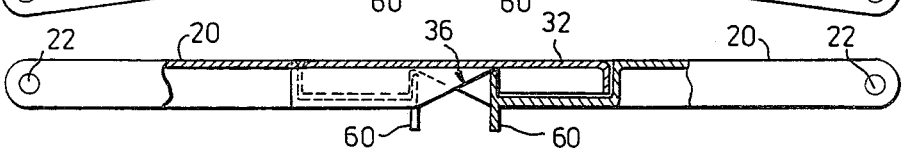
FIG. 5 is a cross-sectional view similar to FIG. 4 showing the cover portions in fully closed position.

When container 10 has been loaded over portions 20 are closed in the manner shown in FIGS. 3 to 5 of the drawings. As cover portions 20 are pivoted into closed position about hinges 22, flanges 40 in recesses 34 of one cover portion move into notches 36 in teeth 32 of the other cover portion whereby when the cover portions are in fully closed position each vertical flange lies adjacent vertical face 38 of an associated notch 36. When cover portions 20 are closed, presenting a flat upper face of cover 18, they may be sealed by passing a wire or similar means (not shown) through apertures 28 and 30 and fastening the ends of the wire together.

When cover portions 20 are closed and sealed any vertical pressure on cover 18 to separate free edges 30 of the cover portions causes flange 40 to bear laterally against vertical face 38 or notch 36 and inhibits the lateral separation of the cover portions, thus thwarting any attempt to pry up the free edge of either cover portion by forcing a tool under either free edge.

Figure 6:
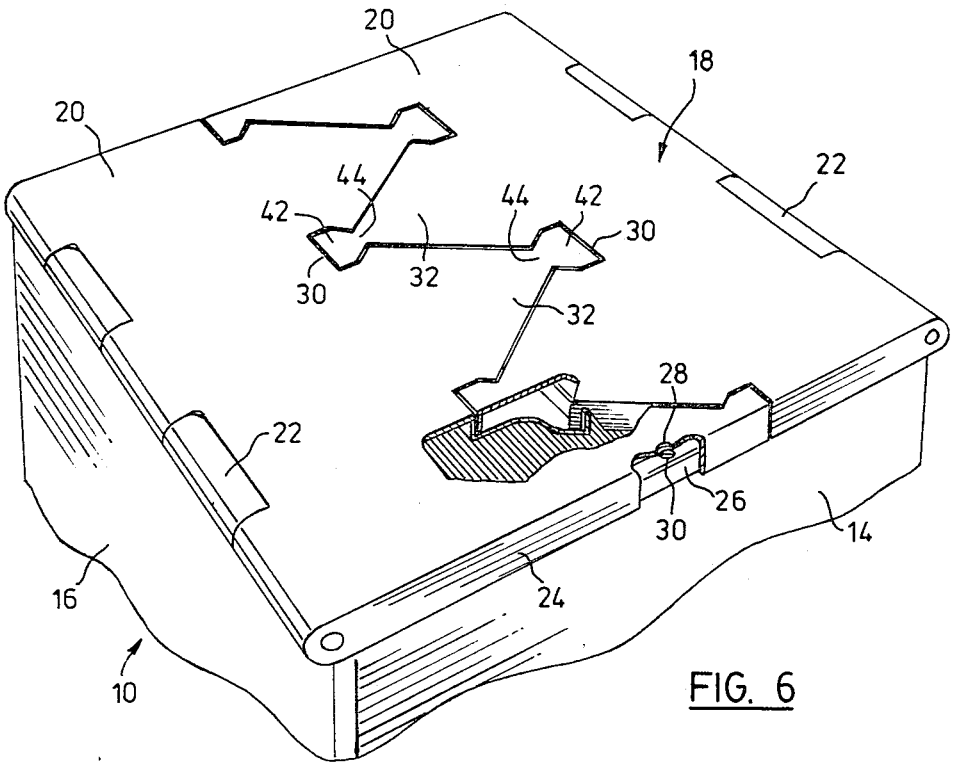
FIG. 6 is a perspective view, similar to FIG. 1, of an alternate embodiment of the invention.
Figure 7:
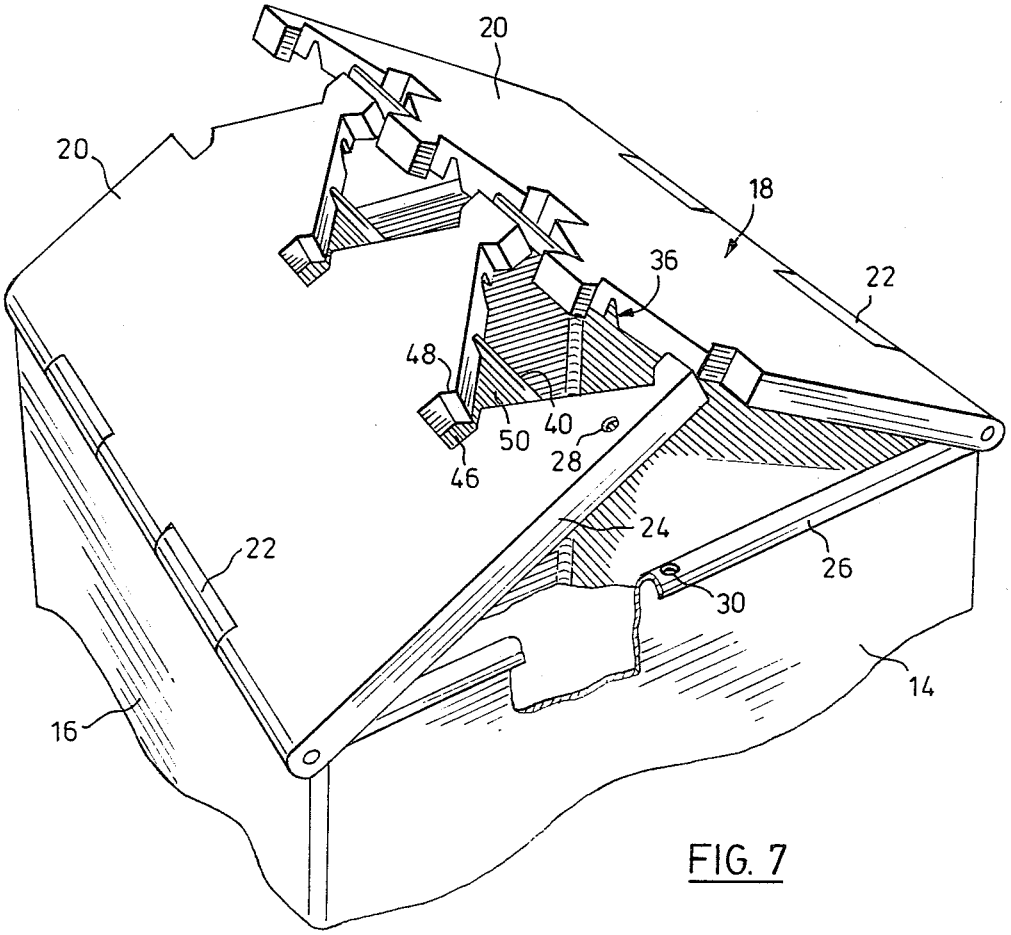
FIG. 7 is a perspective view, similar to FIG. 6, showing the cover portions of the container in partially opened position.

In the alternate example embodiment of the invention shown in FIGS. 6 and 7 of the drawings, each tooth 32 of cover portions 20 is shaped at its free end portion to provide a head 42 defined by a neck 44. Each recess 34 is similarly shaped at its base to provide a pocket 46 to receive head 42 of the interfitting tooth 32 of the opposite cover portion 20. Each pocket 46 is defined by a neck 48. Preferably each tooth 32 carries a notch 36 and each recess is bridged by a flange 40 as in the previous embodiment.

In use, as cover portions 20 of the container of FIGS. 6 and 7 are closed heads 42 of teeth 32 are received in sockets 46 of recesses 34 as seen in FIG. 6. If downward vertical pressure is applied to cover 18 the lateral movement of cover portions 20 away from one another is prevented because heads 42 of teeth 32 bear against necks 48 of pockets 46. If notches 36 and flanges 40 are also provided then the prevention of such lateral separation is reinforced.

The container is preferably constructed of structural foam plastic for rigidity. For still further rigidity, and to save costs, cover portions 20 may be channel shaped in cross-section as seen in FIGS. 3 to 5. Also, each flange 40 may be reinforced by a connecting wall 50 as seen in FIGS. 3 to 5. It will be appreciated that some of flanges 40 and/or heads 42 may be omitted and still achieve the result of the invention.

If desired, some of flanges 40 could be extended downwardly as feet 60 to rest on opposing teeth 32 should an attempt be made to interfit cover portions 20 the wrong way, i.e. with flanges 40 located above the opposite teeth instead of below them. This would provide an exaggerated upward tilt to that cover portion 20 with the downward flange feet 60 resting on the opposite teeth and thus warn that cover 18 is not properly closed.

I claim:

1. A stacking container having a bottom and two pairs of opposed side walls, a cover comprising two portions hinged to one pair of opposed side walls, the opposed lateral edges of each cover portion having means to engage the upper edges of the other pair of opposed side walls of the container when in closed position, the outer free edges of the cover portions meeting, when the cover is in closed position, to present a flat upper surface of the cover, said free edges each being crenellated, with a plurality of spaced teeth having recesses therebetween, to interfit one with the other when closed, means on the underside of each of at least a plurality of teeth and means located in each corresponding recess interengaging when the cover portions are closed to inhibit lateral separation of the cover portions one from the other, each cover portion being sealable one on each of the other pair of opposed side walls, said interengaging means comprising a notch on the underside of each of at least a plurality of said teeth and a substantially vertically disposed flange transversely bridging each of at least a plurality of said recesses, each of said notches having a substantially vertical face on that side of the notch towards the free end of the tooth, and each flange being positioned to lie in the notch of an interfitting tooth adjacent the vertical face thereof when the cover portions are closed.

2. A stacking container having a bottom, a first pair of opposed side walls, a second pair of opposed side walls, and a cover;

said side walls and bottom wall being integrally joined together at their adjacent edges in one piece and being formed of molded synthetic resin to provide an open topped generally rectangular box;

said cover consisting of two cover portions respectively hinged to the side walls of said one pair of side walls so as to have a closed position covering substantially the entire top of said box;

each of said cover portions having three edges overlying respective uppermost edges of three adjacent side walls, and a fourth edge meeting with the fourth edge of the other cover portion;

said cover, when in the closed position, providing a generally flat surface at least as large as and complementary in shape to said bottom wall;

the fourth edge of each of said cover portions being crenellated, with a plurality of spaced teeth interengaging with corresponding spaced teeth of the other cover portion;

each cover portion including a main planar sheet, hinge means along one of said edges opposite said fourth edge, and a depending vertical flange extending along the periphery of said teeth;

a generally vertical lock flange extending generally parallel to said one edge of one cover portion between and connected to adjacent teeth at a position spaced from the base of said teeth away from said one edge; and the other cover portion vertical peripheral flange of at least two adjacent teeth having a notch therein spaced from the free end of the corresponding teeth a distance substantially equal to said spacing of said lock flange and receiving therein said lock flange of the one cover portion when said cover is in its closed position so that the cover portions are positively interengaged to prevent separation within the plane of said closed cover.

3. The container of claim 2, wherein each cover portion is provided with a lock flange between each pair of adjacent teeth and with a peripheral flange, including notches for each tooth;

each of said cover portions further includes a planar connecting wall spaced from and parallel to the planar wall of its cover portion, completely extending between adjacent teeth from said lock flange between adjacent teeth and the adjacent base of said teeth in one piece with the depending flanges of said teeth.

4. The container of claim 3, wherein each of said cover portions includes a depending member extending downwardly below said flange extending between adjacent teeth and within the area between adjacent teeth so as to engage the top of a tooth of the opposite cover portion and prevent movement of the cover portions into the closed position in the event that one cover portion is moved into the closed position prior to movement of the other cover portion into the closed position.

5. The container of claim 4, wherein said member is an extension of and is aligned with each of said lock flanges.

6. The container of claim 2, wherein each of said cover portions includes a depending member extending downwardly below said flange extending between adjacent teeth and within the area between adjacent teeth so as to engage the top of a tooth of the opposite cover portion and prevent movement of the cover portions into the closed position in the event that one cover portion is moved into the closed position prior to movement of the other cover portion into the closed position.

7. The container of claim 6, wherein said member is an extension of and is aligned with each of said lock flanges.

8. The container of claim 2, wherein each of said hinge means defines a hinge axis about which its cover portion pivots;

each of said teeth includes, as viewed in a plane parallel to said cover in its closed position, a head at its outer end, a neck portion immediately adjacent said head and of a width, as measured parallel to said axis that is substantially less than said head portion, and a remainder that first increases in width and then decreases in width to the tooth base so that each tooth and the space between adjacent teeth are mirror images of each other with respect to a line parallel to and midway between the axes of said cover portions, and each tooth being substantially the same shape as the space between adjacent teeth of the opposed cover portion within which it fits in the closed position.

9. The container of claim 8, wherein each cover portion is provided with a lock flange between each pair of adjacent teeth and with a peripheral flange, including notches for each tooth;

each of said cover portions further includes a planar connecting wall spaced from and parallel to the planar wall of its cover portion, completely extending between adjacent teeth from said lock flange between adjacent teeth and the adjacent base of said teeth in one piece with the depending flanges of said teeth.

10. The container of claim 9, wherein each of said cover portions includes a depending member extending downwardly below said flange extending between adjacent teeth and within the area between adjacent teeth so as to engage the top of a tooth of the opposite cover portion and prevent movement of the cover portions into the closed position in the event that one cover portion is moved into the closed position prior to movement of the other cover portion into the closed position.

11. The container of claim 10, wherein said member is an extension of and is aligned with each of said flanges that extend between adjacent teeth.

12. The container of claim 8, wherein each of said cover portions includes a depending member extending downwardly below said flange extending between adjacent teeth and within the area between adjacent teeth so as to engage the top of a tooth of the opposite cover portion and prevent movement of the cover portions into the closed position in the event that one cover portion is moved into the closed position prior to movement of the other cover portion into the closed position.

13. The container of claim 12, wherein said member is an extension of and is aligned with each of said lock flanges.

14. A stacking container having a bottom, a first pair of opposed side walls, a second pair of opposed side walls, and a cover;

said side walls and bottom wall being integrally joined together at their adjacent edges in one piece and being formed of molded synthetic resin to provide an open topped generally rectangular box;

said cover consisting of two cover portions respectively hinged to the side walls of said one pair of side walls so as to have a closed position covering substantially the entire top of said box;

each of said cover portions having three edges overlying respective uppermost edges of three adjacent side walls, and a fourth edge meeting with the fourth edge of the other cover portion;

said cover, when in the closed position, providing a generally flat surface at least as large as and complementary in shape to said bottom wall;

the fourth edge of each of said cover portions being crenellated, with a plurality of spaced teeth interengaging with corresponding spaced teeth of the other cover portion;

each of said hinge means defining a hinge axis about which its cover portion pivots;

each of said teeth including, as viewed in a plane parallel to said cover in its closed position, a head at its outer end, a neck portion immediately adjacent said head and of a width, as measured parallel to said axis that is substantially less than said head portion, and a remainder that first increases in width and then decreases in width to the tooth base so that each tooth and the space between adjacent teeth are mirror images of each other with respect to a line parallel to and midway between the axes of said cover portions, and each tooth being substantially the same shape as the space between adjacent teeth of the opposed cover portion within which it fits in the closed position.

15. A stacking container having a bottom, a first pair of opposed side walls, a second pair of opposed side walls, and a cover;

said side walls and bottom wall being integrally joined together at their adjacent edges in one piece and being formed of molded synthetic resin to provide an open topped generally rectangular box;

said cover consisting of two cover portions respectively hinged to the side walls of said one pair of side walls so as to have a closed position covering substantially the entire top of said box;

each of said cover portions having three edges overlying respective uppermost edges of three adjacent side walls, and a fourth edge meeting with the fourth edge of the other cover portion;

said cover, when in the closed position, providing a generally flat surface at least as large as and complementary in shape to said bottom wall;

the fourth edge of each of said cover portions being crenellated, with a plurality of spaced teeth interengaging with corresponding spaced teeth of the other cover portion;

at least one foot member depending integrally from each of said cover portions a substantial distance below the remainder of said cover portion in said closed position immediately below the space between adjacent teeth of its cover portion for each of said cover portions so that the bottom of said foot member will engage the top of the corresponding tooth of the opposed cover portion if said opposed cover portion is moved into its closed position prior to the cover portion of said foot member to prevent said cover portions from assuming said closed position unless they are simultaneously closed.

16. The container of claim 15, wherein each of said hinge means defines a hinge axis about which its cover portion pivots:

each of said teeth includes, as viewed in a plane parallel to said cover in its closed position, a head at its outer end, a neck portion immediately adjacent said head and of a width, as measured parallel to said axis that is substantially less than said head portion, and a remainder that first increases in width and then decreases in width to the tooth base so that each tooth and the space between adjacent teeth are mirror images of each other with respect to a line parallel to and midway between the axes of said cover portions, and each tooth being substantially the same shape as the space between adjacent teeth of the opposed cover portion within which it fits in the closed position.

* * * * *